US007446329B2

(12) United States Patent
Bristol et al.

(10) Patent No.: US 7,446,329 B2
(45) Date of Patent: Nov. 4, 2008

(54) EROSION RESISTANCE OF EUV SOURCE ELECTRODES

(75) Inventors: Robert Bristol, Portland, OR (US); Arun Ramamoorthy, Milipitas, CA (US); Bryan J. Rice, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 900 days.

(21) Appl. No.: 10/638,261

(22) Filed: Aug. 7, 2003

(65) Prior Publication Data

US 2005/0031502 A1 Feb. 10, 2005

(51) Int. Cl.
*H01J 35/00* (2006.01)

(52) U.S. Cl. ..... 250/504 R; 250/493.1; 378/119

(58) Field of Classification Search ..... 250/504 R; 219/69.12, 69.17, 69.2, 69.16; 378/119
See application file for complete search history.

(56) References Cited

U.S. PATENT DOCUMENTS 5,176,557 A * 1/1993 Okunuki et al. ..... 445/24
6,566,667 B1 * 5/2003 Partlo et al. ..... 250/504 R
6,809,328 B2 * 10/2004 Chandhok et al. ..... 250/504 R
7,002,168 B2 * 2/2006 Jacob et al. ..... 250/504 R
7,049,614 B2 * 5/2006 Rice ..... 250/504 R
7,115,887 B1 * 10/2006 Hassanein et al. ..... 250/504 R
7,150,746 B2 * 12/2006 DeCesare et al. ..... 606/41
7,291,853 B2 * 11/2007 Fomenkov et al. ..... 250/504 R
2002/0014599 A1 * 2/2002 Rauch et al. ..... 250/504 R
2002/0100882 A1 * 8/2002 Partlo et al. ..... 250/504 R
2003/0006383 A1 * 1/2003 Melnychuk et al. ..... 250/504 R
2004/0071267 A1 * 4/2004 Jacob et al. ..... 378/119
2004/0108473 A1 * 6/2004 Melnychuk et al. ..... 250/504 R
2004/0120461 A1 * 6/2004 Chandhok et al. ..... 378/119
2004/0124373 A1 * 7/2004 Rice et al. ..... 250/504 R
2004/0127012 A1 * 7/2004 Jin ..... 438/618
2004/0140439 A1 * 7/2004 Shell et al. ..... 250/504 R
2004/0145292 A1 * 7/2004 Ahmad et al. ..... 313/231.31
2004/0150311 A1 * 8/2004 Jin ..... 313/309
2004/0160155 A1 * 8/2004 Partlo et al. ..... 313/231.31
2005/0092728 A1 * 5/2005 Barbeau et al. ..... 219/229
2006/0057388 A1 * 3/2006 Jin et al. ..... 428/408
2007/0023706 A1 * 2/2007 Sjmaenok et al. ..... 250/504 R
2007/0023711 A1 * 2/2007 Fomenkov et al. ..... 250/504 R

* cited by examiner

*Primary Examiner*—Nikita Wells
*Assistant Examiner*—Johnnie L Smith, II
(74) *Attorney, Agent, or Firm*—Fish & Richardson P.C.

(57) ABSTRACT

Erosion of material in an electrode in a plasma-produced extreme ultraviolet (EUV) light source may be reduced by treating the surface of the electrode. Grooves may be provided in the electrode surface to increase re-deposition of electrode material in the grooves. The electrode surface may be coated with a porous material to reduce erosion due to brittle destruction. The electrode surface may be coated with a pseudo-alloy to reduce erosion from surface waves caused by the plasma in molten material on the surface of the electrode.

33 Claims, 5 Drawing Sheets

EROSION RESISTANCE OF EUV SOURCE ELECTRODES

BACKGROUND

Lithography is used in the fabrication of semiconductor devices. In lithography, a light sensitive material, called a "photoresist", coats a wafer substrate, such as silicon. The photoresist may be exposed to light reflected from a mask to reproduce an image of the mask, which is used to define a pattern on the wafer. When the wafer and mask are illuminated, the photoresist undergoes chemical reactions and is then developed to produce a replicated pattern of the mask on the wafer.

Extreme Ultraviolet (EUV) lithography is a promising future lithography technique. EUV light may be produced using a small, hot plasma which will efficiently radiate at a desired wavelength, e.g., in a range of approximately 11 nm to 15 nm. The plasma may be created in a vacuum chamber, typically by driving a pulsed electrical discharge through the target material or by focusing a pulsed laser beam onto the target material. The light produced by the plasma is then collected by nearby mirrors and sent downstream to the rest of the lithography tool.

The hot plasma tends to erode materials nearby, e.g., the electrodes in electric-discharge sources. The eroded material may coat the collector optics, resulting in a loss of reflectivity and reducing the amount of light available for lithography.

DETAILED DESCRIPTION

Figure 1:
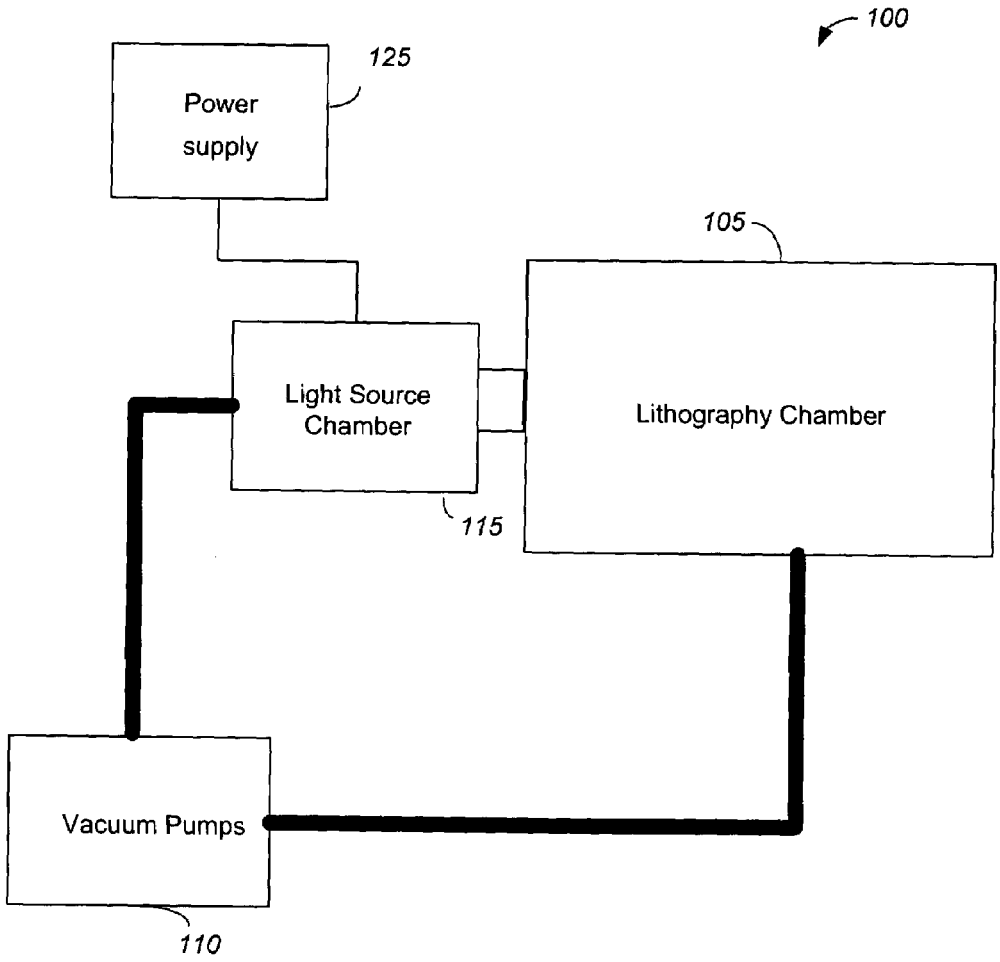
FIG. 1 is a block diagram of a lithography system.

FIG. 1 shows a lithography system 100. A wafer, coated with a light sensitive coating, and a mask are placed in a lithography chamber 105. The pressure in the lithography chamber may be reduced to a near vacuum environment by vacuum pumps 110. A light source chamber 115, which houses a light source, is connected to the lithography chamber 105. The pressure in the light source chamber may also be reduced to a near vacuum environment by the vacuum pumps 110.

The light source chamber 115 may house an EUV light source. A power supply 125 is connected to the EUV chamber to supply energy for creating an EUV-emitting plasma, which provides EUV light for lithography. The EUV light may have a wavelength in a range of 11 nm to 15 nm, e.g., 13.5 nm. The source may be a plasma light source, such as a pinch plasma source. Plasma-producing components (e.g., electrodes) in the EUV source may excite a gas to produce EUV radiation.

Figure 2:
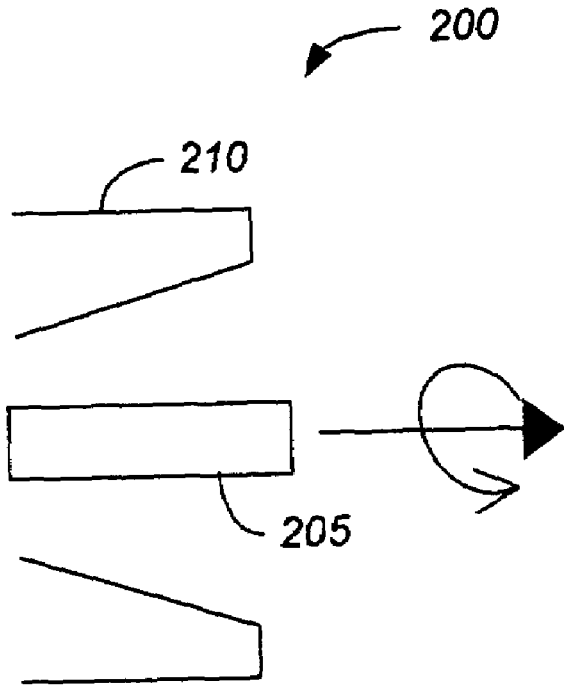
FIG. 2 is a sectional view of a cylindrical pair of electrodes in a plasma-produced light source.

FIG. 2 shows an exemplary electrode-pair 200 in the light source. The electrode may include a central anode 205 surrounded by a cylindrical cathode 210. Tungsten (W) may be used for the electrodes and other components in the EUV source because it is relatively resistant to plasma erosion. However, plasma erosion may still occur, and the debris produced by the erosion may be deposited on collector mirrors in the lithography chamber. Debris particles may coat the collector mirrors, resulting in a loss of reflectivity.

There are several erosion mechanisms which may affect the electrodes. There may be a strong input of energy from the plasma to the electrodes from ions and electrons which follow electromagnetic field lines into the electrode surface. The erosion may be attributed to the high temperature and sputtering caused by the collisions of the ions and electrons with the surface. The erosion mechanisms may include vaporization and melting of a thin surface layer of the electrode material, volumetric boiling and explosion of large bubbles developed in the surface layer, and splashing of the molten metal at the electrode surface due to surface wave excitation.

Figure 3:
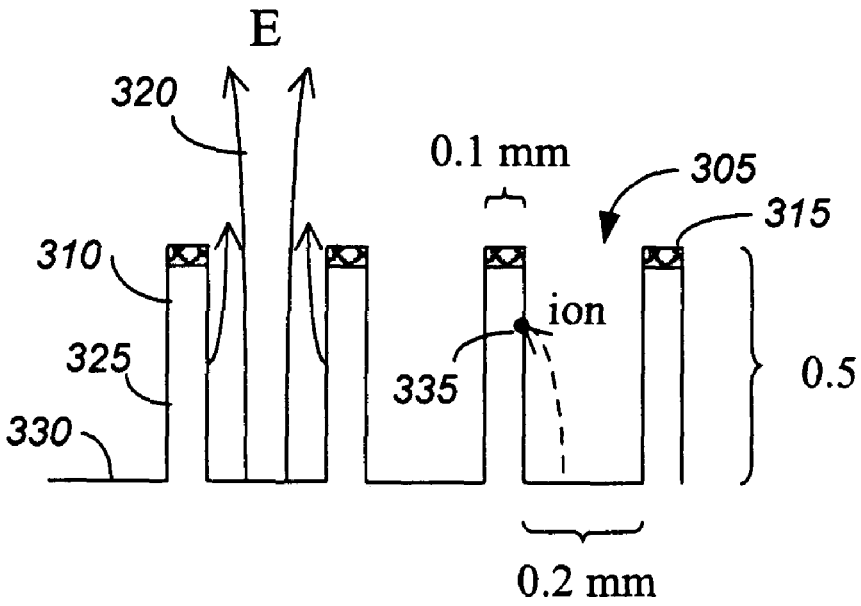
FIG. 3 is a sectional view of a grooved surface in an electrode.

In an embodiment, net erosion due to sputtering may be decreased by increasing re-deposition of sputtered ions onto the electrode surface. The re-deposition may be increased by applying grooves to the electrode surface. FIG. 3 shows the grooved surface to be applied to an electrode in FIG. 2, in this case the central anode. The grooves 305 increase the effective surface area of the electrode, thereby decreasing the energy intensity seen at the electrode surface.

The tips of the ribs 310 between grooves 305 may be coated with an insulating dielectric material 310 to divert the plasma current(indicated by lines 320) to attach to the groove sidewalls 325 and troughs 330 instead of the tips of the ribs. This may cause the current density striking the surface of the electrode to decrease. This in turn may cause the erosion rate of the material to decrease, as one of the primary erosion mechanisms is vaporization and melting in a thin surface layer of the material. One example of the dielectric insulating material would be CVD diamond.

Another phenomena that the grooves 305 may display is the re-deposition of material in the groove. This effect depends on the material to be re-deposited. If it is a weakly ionized micro-droplet, inertial effects may overcome the electrical forces, and material from one sidewall may travel to the other. If it is very small, highly ionized clusters, or individual ions 335, the interaction with the electric field may dominate.

The grooves may be applied by machining grooves into the electrode, e.g., in a lathe. Alternatively, the grooves may be etched by rotating the electrode component in an etch chamber.

In an embodiment, erosion of the electrode material due to volumetric boiling and explosion of large bubbles may be reduced by providing a layer of porous material at the electrode surface. Electrode materials such as tungsten may have gases dissolved in the material. At high temperatures, the pressure inside the material increases and bubbles may form. When the pressure inside the bubbles increases significantly, the bubbles explode, resulting in brittle destruction of the material.

The pore radius is inversely proportional to the density of gases in the material as pressure increases. By increasing the pore size, bubbles and absorbed gases can be released much earlier. Thus, by increasing the porosity, the erosion rate can be substantially decreased. However, increasing the porosity may conflict with the thermal requirements of the electrode, since increasing the porosity decreases the heat transfer capability.

Figure 4:
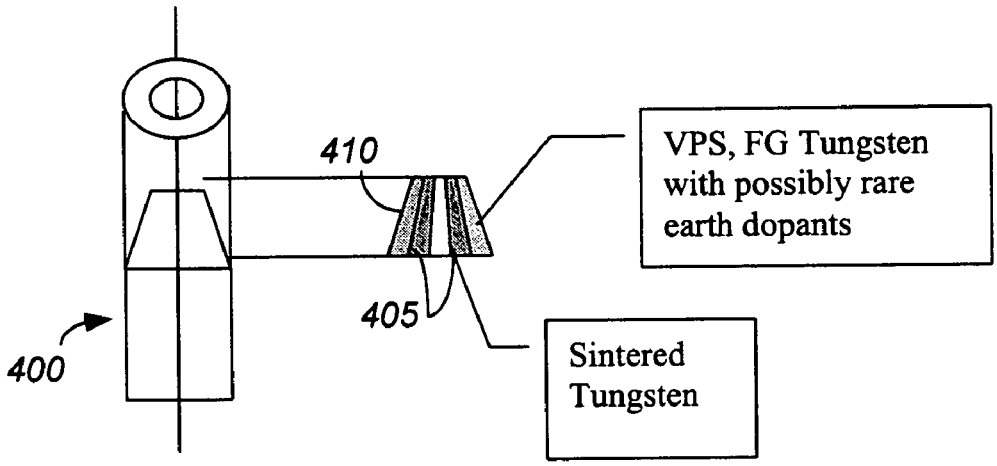
FIG. 4 is a sectional view of an electrode including a coating of a porous material.

As shown in FIG. 4, an electrode may include a core of sintered tungsten 405 coated with a layer of porous material 410 to reduce erosion due to brittle destruction without sacrificing heat removal. The sintered tungsten may provide relatively good thermal conductivity, and may constitute the bulk of the electrode. The porous tungsten may be doped with a rare earth element to tailor the thermal conductivity of the porous layer. Impregnated porous tungsten on solid tungsten (W-1% $La_2O_3$) may provide adequate porosity and heat conduction properties for electrode applications. The porous tungsten may be, e.g., vacuum plasma sprayed (VPS) tungsten or functionally graded (FG) tungsten, which may provide the necessary homogeneity and porosity. The thickness of the porous layer may be adjusted based on the erosion rate of the material.

As described above, another mechanism for macroscopic erosion is the splashing of molten metal due to surface wave excitation at temperatures $T_s > T_{melt}$, where $T_s$ is the surface temperature and $T_{melt}$ is the melting point. Energetic particles from the plasma may cause the surface wave excitation. Splashing caused by the surface wave excitation may result in relatively rapid erosion of the electrode material.

Figure 5:
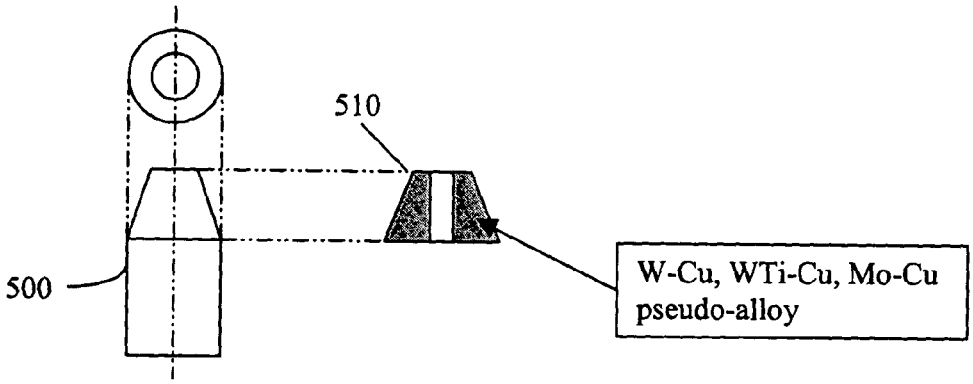
FIG. 5 is a sectional view of an electrode including a coating of a pseudo-alloy.

As shown in FIG. 5, an electrode 500 may be formed of a structured pseudo-alloy material 510 to reduce erosion due to splashing of molten metal due to surface wave excitation. Pseudo-alloys differ from alloys in that the materials constituting a pseudo-alloy are mechanically rather than chemically bonded, e.g., the materials retain their individual properties, such as melting temperature. The pseudo-alloy may have a "backbone" of a porous high-melting point material (the "matrix" material) surrounding a lower-melting point material (the "filler" or fusible material). The high-melting point material serves to suppress motion of the surface waves that would otherwise eject the lower-melting point material. When the filler material melts, the solid matrix structure at the surface may act as a break wall to inhibit the motion of the waves.

Exemplary matrix materials include tungsten, molybdenum, and a tungsten-nickel-alloy. An exemplary fusible material is copper. The pseudo-alloy may be created either through infiltration or vitrification. Infiltration consists of the formation of a pseudo-alloy by mixing powdered matrix and fusible material and hot sintering them in an iterative process (heat and press, wait, repeat, etc). The resultant pseudo-alloy tends to have low porosity (high density), but the increased temperature, pressure, and number of iterations increase the density and reduce the pore size of the resultant pseudo-alloy. Vitrification consists of first forming the matrix material into a porous solid using sintering. The fusible material is then infused into the porous matrix by hot pressing fusible briquettes or by hot dipping in molten fusible material. The vitrification process tends to yield pseudo-alloys with higher porosity (lower density). In both processes the pore size of the final product is related to the order of the grain size of the powder used during the sintering process and can vary from tens of nanometers to about 10 microns.

Pseudo-alloys have been used as electrodes in various high-current applications in the past, such as arc welding. In those situations the objective is to create materials with the highest current carrying capability and lowest electrical resistance, as well as good thermal conductivity. The microscopic properties required for this are low porosity, small grain and pore sizes (in the tens of nanometers) and high density. For EUV source electrode applications, the electrical properties are relevant, but not as critical. Increasing the pore size can improve the thermal conductivity in direct proportion to the fusible content, but this impairs the electrical conductivity and resistance. Since the EUV gas discharge source is pulsed, the current is carried through the electrodes for only a very short period of time (say 10-100 ns) compared with off-state times of 0.1-1 ms and therefore the electrical properties are less important than in arc-welding. The choice of pseudo-alloys for EUV source electrodes is therefore governed by the material erosion properties, and this claim in particular relates to the fabrication and use of large pore size pseudo-alloys with fusible material pores on the order of 1-10 microns, so chosen to reduce the impact of the "splashing" type macroscopic erosion mechanism.

A number of embodiments have been described. Nevertheless, it will be understood that various modifications may be made without departing from the spirit and scope of the invention. Accordingly, other embodiments are within the scope of the following claims.

The invention claimed is:

1. An apparatus comprising:

an electrode-pair operative to generate a plasma, one or more of the electrodes including a surface having a plurality of grooves.

2. The apparatus of claim 1, wherein the plasma comprises an extreme ultraviolet-emitting plasma.

3. The apparatus of claim 1, wherein one or both of the electrodes comprise tungsten.

4. The apparatus of claim 1, wherein the surface comprises an anode surface.

5. The apparatus of claim 1, wherein the grooves have a width of about 1 mm.

6. The apparatus of claim 1, wherein adjacent grooves are separated by a rib.

7. The apparatus of claim 6, wherein the rib has a width of about 0.5 mm.

8. The apparatus of claim 6, wherein the rib has a tip covered with a dielectric insulating material.

9. An apparatus comprising:

an electrode operative to generate a plasma, the electrode including a solid base, and a surface, surrounding the solid base, that includes a porous material.

10. The apparatus of claim 9, wherein the plasma comprises an extreme ultraviolet photon emitting plasma.

11. The apparatus of claim 9, wherein the solid base comprises tungsten.

12. The apparatus of claim 9, wherein the surface comprises an anode surface.

13. The apparatus of claim 9, wherein the porous material has a porosity operative to facilitate the release of bubbles and absorbed gases.

14. The apparatus of claim 9, wherein the porous material comprises porous tungsten.

15. The apparatus of claim 14, wherein the porous tungsten comprises vacuum plasma sprayed tungsten.

16. The apparatus of claim 14, wherein the porous tungsten comprises functionally graded tungsten.

17. The apparatus of claim 9, wherein the porous material comprises a dopant to improve a thermal conductivity of the porous material.

18. The apparatus of claim 17, wherein the dopant comprises a rare earth metal.

19. An apparatus comprising:

an electrode operative to generate a plasma, the electrode including a pseudo-alloy comprising a matrix material and a filler material that are mechanically bonded together in the solid bulk of the electrode, the matrix material having a higher melting temperature than the filler material.

20. The apparatus of claim 19, wherein the plasma comprises an extreme ultraviolet photon emitting plasma.

21. The apparatus of claim 19, wherein the matrix material comprises tungsten.

22. The apparatus of claim 19, wherein the matrix material comprises a tungsten-nickel alloy.

23. The apparatus of claim 19, wherein the filler material comprises copper.

24. The apparatus of claim 19, wherein the matrix material is operative to suppress motion of surface waves caused by the plasma in molten filler material.

25. The apparatus of claim 1, further comprising:

a collection of extreme ultraviolet mirrors disposed to collect extreme ultraviolet light emitted by the plasma; and a vacuum chamber to enclose the electrode-pair and the collection of extreme ultraviolet mirrors.

26. The apparatus of claim 25, further comprising a source of a gas that, when ionized, produces extreme ultraviolet radiation.

27. The apparatus of claim 9, further comprising:

a collection of extreme ultraviolet mirrors disposed to collect extreme ultraviolet light emitted by the plasma; and a vacuum chamber to enclose the electrode and the collection of extreme ultraviolet mirrors.

28. The apparatus of claim 27, further comprising a source of a gas that, when ionized, produces extreme ultraviolet radiation.

29. The apparatus of claim 19, further comprising:

a collection of extreme ultraviolet mirrors disposed to collect extreme ultraviolet light emitted by the plasma; and a vacuum chamber to enclose the electrode and the collection of extreme ultraviolet mirrors.

30. The apparatus of claim 29, further comprising a source of a gas that, when ionized, produces extreme ultraviolet radiation.

31. The apparatus of claim 1, wherein each of the plurality of grooves comprises a pair of sidewalls and a bottom trough.

32. The apparatus of claim 31, wherein the sidewalls are separated by a distance that allows inertial effects on at least some ionized micro-droplets to overcome electrical forces so that the at least some ionized micro-droplets traverse from one sidewall to the other.

33. The apparatus of claim 1, wherein the solid base comprises a solid core.

* * * * *